United States Patent [19]

Hoshi

[11] Patent Number: 4,779,443

[45] Date of Patent: Oct. 25, 1988

[54] COMPLEX PRESSING DIE APPARATUS

[75] Inventor: Hideo Hoshi, Nagoya, Japan

[73] Assignee: Toyoshima Kabushiki Kaisha, Aichi, Japan

[21] Appl. No.: 69,077

[22] Filed: Jul. 2, 1987

[30] Foreign Application Priority Data

Jul. 3, 1986 [JP] Japan ..... 61-156828

[51] Int. Cl.[4] ..... B21D 22/28

[52] U.S. Cl. ..... 72/349; 72/350

[58] Field of Search ..... 72/347, 349, 350

[56] References Cited

U.S. PATENT DOCUMENTS

| | | | |
|---|---|---|---|
| 4,248,076 | 2/1981 | Bulso, Jr. et al. | 72/349 |
| 4,309,888 | 1/1982 | Miller et al. | 72/350 |
| 4,499,750 | 2/1985 | Gerber et al. | 72/349 |
| 4,589,270 | 5/1986 | Lee, Jr. et al. | 72/349 |
| 4,620,434 | 11/1986 | Pulciano et al. | 72/349 |

*Primary Examiner*—W. Donald Bray

*Attorney, Agent, or Firm*—Armstrong, Nikaido, Marmelstein & Kubovcik

[57] ABSTRACT

A complex pressing die apparatus having a plurality of upper and lower dies which are actuated by respective hydraulic cylinder devices which are located in a coaxial arrangement, respectively, in accordance with a predetermined sequence.

2 Claims, 3 Drawing Sheets

COMPLEX PRESSING DIE APPARATUS

BACKGROUND OF THE INVENTION

1. Field of the Invention

The present invention relates to a complex pressing die apparatus, and more precisely it relates to a pressing die apparatus for carrying out different press operations by the same and single die apparatus.

2. Description of the Related Arts

For instance, metal products, such as automobile parts, domestic electric goods or miscellaneous goods are usually formed by pressing a blank by means of different dies and punches at different press stages, in accordance with desired shapes of the products. It is necessary to mount and dismount different dies (and punches) to and from the press machine, in accordance with the products.

However, such a tooling (mounting and dismounting) operation for mounting and dismounting different dies (and punches) is a nonproductive task. In order to increase productivity, it is necessary to decrease the time needed for tooling.

To this end, various devices, such as moving beds, die lifters, or die rails have been proposed to carry out a quick tooling. However, these devices result in an increase of the whole size of the press machine and the cost of equipment. It also should be borne in mind that those devices themselves do not directly contribute to the press operation of the products.

In addition to the foregoing, the tooling operation increases a possibility of industrial accidents, since tooling must be effected in a large press machine. The primary object of the present invention is, therefore, to provide a pressing die apparatus which can substantially prevent the industrial accidents and which can carry out different press operations without using a conventional large press machine.

Another object of the present invention is to provide a complex pressing die apparatus which can perform different press operations, in accordance with a predetermined sequential control.

SUMMRAY OF THE INVENTION

To achieve the objects mentioned above, according to the present invention, there is provided a complex pressing die apparatus comprising upper and lower die assemblies having a plurality of upper and lower dies which are simultaneously or successively actuated by respective hydraulic cylinder devices. The cylinder devices for the upper dies and/or the cylinder devices for the lower dies are coaxially arranged, respectively. With this arrangement, the hydraulic cylinder devices are used as drives for the upper and lower dies, instead of the press machine in the prior art. The coaxial arrangement of the multiple cylinder devices contributes to a realization of a compact and small die apparatus. Various press operations can be easily effected by simultaneously or successively operating the associated cylinder devices, in accordance with a predetermined sequence.

BRIEF DESCRIPTION OF THE DRAWINGS

The invention will be described below, with reference to the accompanying drawings, in which.

DESCRIPTION OF PREFERRED EMBODIMENTS

Figure 3:
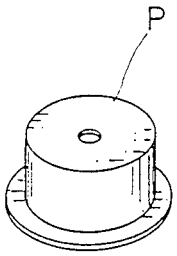
FIG. 3 is a perspective view of a product obtained by the present invention; and, FIG. 4 is a sectional view showing successive pressing stages, according to the pressing invention.

In the illustrated embodiment, the product P is a container of a brake booster, as shown in FIG. 3.

Figure 1:
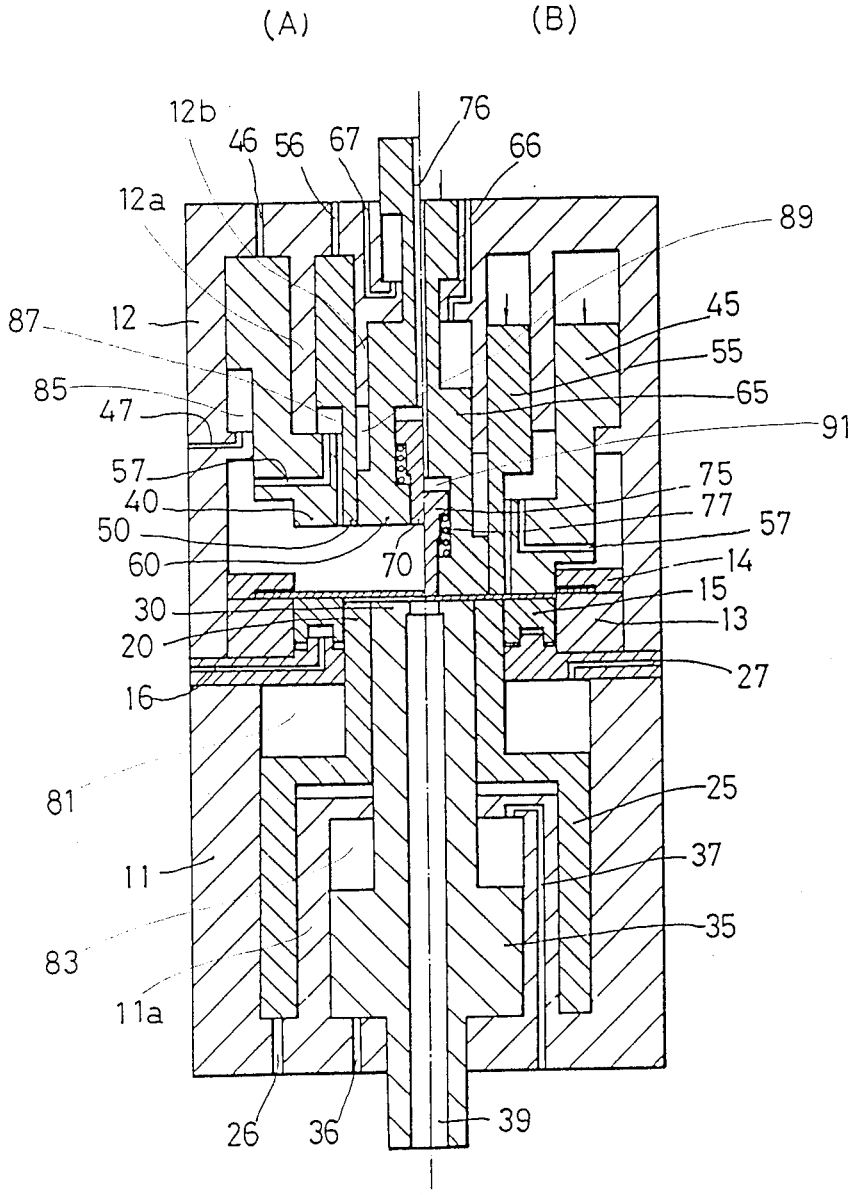
FIG. 1 is a longitudinal sectional view of a complex pressing die apparatus according to the present invention, shown in different positions on the right and left halves of the figure.
Figure 2:
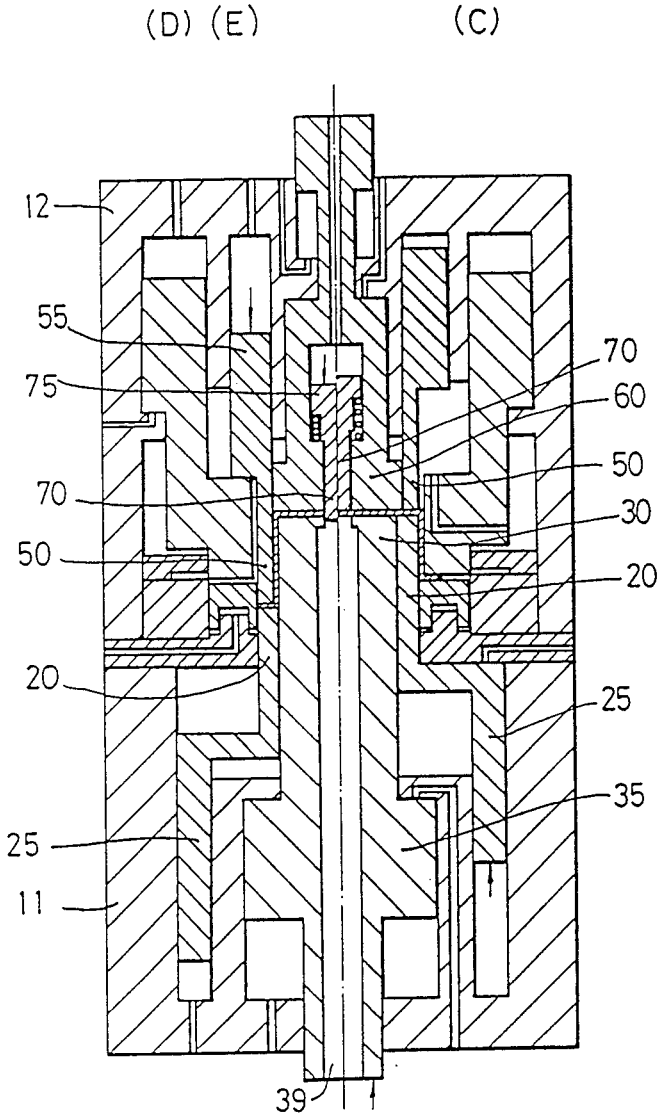
FIG. 2 is a longitudinal sectional view of a complex pressing die apparatus according to the present invention, shown in three different positions.
Figure 4:
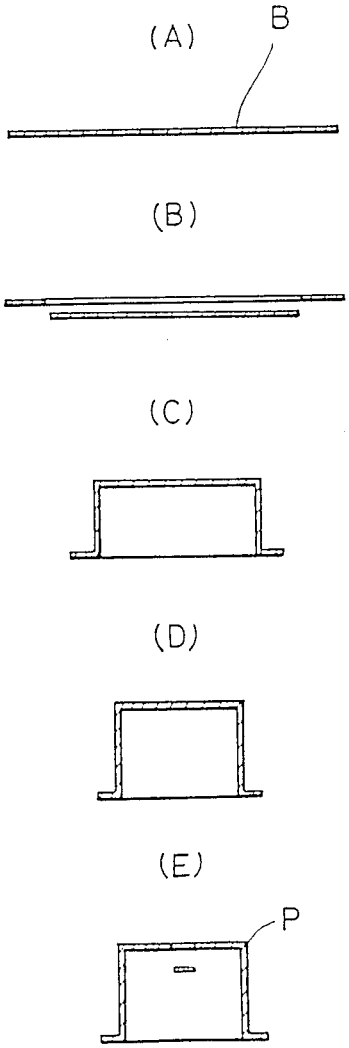

In FIGS. 1 and 2 which shows a die apparatus of the present invention, the pressing operations are successively effected in the alphabetical order of A, B, C, D and E. Namely, in FIGS. 1 and 2, different pressing positions A and B, and C, D and E are shown, respectively. The positions A, B, C, D and E correspond to steps A, B, C, D and E in FIG. 4.

In FIGS. 1 and 2, the die apparatus is used for drawing and punching. The apparatus has a lower frame 11 which has therein a lower die assembly consisting of an outer punch 20 and an inner punch 30 coaxial to the outer 20, and an upper frame 12 which has therein an upper die assembly consisting of a die 40, an inner die 50 in the die 40, a knockout 60 in the inner die 50 and a piercing punch 70 located innermost. The die 40, the inner die 50, the knockout 60 and the piercing punch 70 are coaxial to each other in the upper frame 12. The elements 20, 30, 40, 50, 60 and 70 mentioned above can be actuated independently of each other by respective hydraulic cylinder devices. Namely, the outer punch 20 is actuated by a piston 25 integral therewith which is slidably arranged in the lower frame 11 which serves as a cylinder for the piston 25. The cylinder chamber 81 defined by the lower frame 11 is connected to a pressurized fluid source (not shown) through a first port 26 and a second port 27 on the opposite sides of the piston 25. When the piston 25 moves forward, i.e. upward in FIG. 1, the working fluid is fed in the cylinder chamber through the first port 26 and is discharged therefrom through the second port 27. On the other hand, when the pistons 25 moves downward in FIG. 1, the working fluid is fed in the cylinder chamber 81 through the second port 27 and is discharged therefrom through the first port 26. That is, the piston 25 is a double acting piston.

Similarly, the inner punch 30 has a piston 35 which is slidably inserted in a cylinder 11a defined by the lower frame 11. The cylinder chamber 83 defined in the cylinder 11*a* is connected to the pressurized fluid source (not shown) through a third port 36 and a fourth port 37 on the opposite sides of the piston 35. The third and fourth ports 36 and 37 correspond to the first and second ports 26 and 27 and function accordingly, respectively.

The die 40 has a piston 45 integral therewith which is slidably inserted in the upper frame 12 which serves as a cylinder.

The cylinder chamber 85 defined by and in the cylinder 12 is connected to the pressurized fluid source through fifth and sixth ports 46 and 47 on the opposite sides of the piston 45, respectively. When the piston 45 moves toward the lower frame 11, the working fluid is introduced in the cylinder chamber 85 through the fifth port 46 and discharged from the cylinder chamber 85 through the fifth port 46 and discharged from the cylinder chamber 85 through the sixth port 47 and vice versa.

Similarly, the inner die 50 has a piston 55 which is slidably inserted in a cylinder 12*a* formed by the upper frame 12. They cylinder chamber 87 defined in and by the cylinder 12*a* is connected to the fluid source through seventh and eighth ports 56 and 57 on the opposite sides of the piston 55. The seventh and eighth ports 56 and 57 are equivalent in function to the fifth and sixth ports 46 and 47, respectively.

The knockout 60 has a piston 65 which is slidably inserted in a cylinder 12*b* formed by the upper frame 12. The cylinder chamber 89 defined in and by the cylinder 12*b* is connected to the fluid source through ninth and tenth ports 66 and 67. The piercing punch 70 has a piston 75 which is slidably inserted in the piston 65 of the knockout 60. The cylinder chamber 91 defined in and by the piston 65 is connected to the fluid source through an eleventh port 76. The return movement of the piston 75 is effected by a return spring 77. Scraps of blank are discharged through a scrap chute 39 provided in the inner punch 30.

In FIGS. 1 and 2, the numeral 13 designates a die for the blank, i.e. for the moving die 40, 14 a gate for the blank, 15 a die cushion cylinder piston for a pressure pad, and 16 a fluid port through which a pressurized oil can be exerted on the cylinder piston 15 in order to act a proper back pressure thereon.

The die apparatus shown in FIGS. 1 and 2 operates as follows. First, as shown in FIG. 1(A) and FIG. 4(A), the blank B to be pressed is inserted in the blank gate 14. In this state, the dies and punches of the lower and upper frames 11 and 12 are all located at their initial positions (retracted positions).

After that, as can be seen from FIG. 1(B) and FIG. 4(B), the blank B is punched by the die 40. In the illustrated embodiment, when or shortly after the die 40 moves forward, i.e. downward in the drawings, the inner die 50, the knockout 60 and the piercing punch 70 move forward together to assist the punching operation by the die 40. After that, the operation proceed to a next stage shown in FIG. 2(C). In this stage, as can be seen from FIG. 4(C), drawing (first drawing) can be effected. In this first drawing stage, the outer punch 20 and the inner punch 30, in the inner die 50 and the knockout 60, in the upper frame 12 move backward (upward) together to serve as a knockout.

As shown in FIG. 2(D) and FIG. 4(D) which show a deep drawing stage (second drawing), subsequent to the first drawing, the working fluid pressure exerting on the outer punch 20 in the lower frame 11 is then reduced, and the inner die 50 moves forward (downward) to carry out the deep drawing.

After the deep drawing ends, the piercing punch 70 moves forward (downward) to pierce the center portion of the blank, as shown in FIG. 2(E) and FIG. 4(E). The scraps which are produced during piercing are discharged through the scrap chute 39 from the die apparatus.

The operations of the cylinder devices of the dies (and punches) in the upper and lower frames 11 and 12 can be automatically and successively or simultaneously effected in accordance with a predetermined sequence by means of a known hydraulic control device.

It should be appreciated that the dies can be replaced with proper dies in accordance with the shape of products to be pressed.

As can be seen from the foregoing, according to the present invention, since one or both of the upper die assembly and lower die assembly is or are actuated by the respective hydraulic cylinder devices which are coaxially arranged and which operate simultaneously or successively, respectively, different press operations can be effected without troublesome tooling (or settling-up).

This results in a reduction of the time for tooling and also in a decrease of an occurrence of industrial accidents.

Furthermore, according to the present invention, no large press machine is necessary and the number of dies can be decreased, because of the complex pressing operations, resulting in a minimization of the space for the die apparatus and also in a decrease of the equipment cost of the associated devices.

By a proper geometrical arrangement of the hydraulic cylinder devices and by a proper design of the output conditions thereof, various press operations can be automatically and optionally carried out.

It is also possible to connect the hydraulic cylinder devices to a computerized controller.

The apparatus of the present invention can be advantageously and practically used to press various shapes of products.

I claim:

1. A complex pressing die apparatus comprising an upper frame having an upper die assembly movably mounted therein and a lower frame, in axial alignment with said upper frame and having a lower die assembly mounted therein, said upper die assembly movably mounted in said upper frame and said lower die assembly movably mounted in said lower frame being in axial, face-to-face alignment, each die of said upper die assembly and each die of said lower die assembly having a two-way hydraulic cylinder and piston for advancing and retracting each said die in one assembly toward and away from the die in the other assembly independent of the other dies in the one assembly and the other assembly, the piston of the two way hydraulic cylinder of each said die of said upper die assembly and the piston of the two way hydraulic cylinders of each said die of said lower die assembly being in axial alignment with the axis of said upper die assembly and said lower die assembly, respectively, said pistons being integral with said dies.

2. A die apparatus, as recited in claim 1, wherein said upper die assembly includes a piercing punch and said lower die assembly includes a discharge chute in axial alignment with said piercing punch for discharge from said die apparatus scrap blanks produced with said punch.

* * * * *